US012741226B2

(12) United States Patent
Chandler

(10) Patent No.: US 12,741,226 B2
(45) Date of Patent: Sep. 22, 2026

(54) TALKING WILD WEST ACTION FIGURE

(71) Applicant: Chris Chandler, Orange Park, FL (US)

(72) Inventor: Chris Chandler, Orange Park, FL (US)

( * ) Notice: Subject to any disclaimer, the term of this patent is extended or adjusted under 35 U.S.C. 154(b) by 216 days.

(21) Appl. No.: 18/588,607

(22) Filed: Feb. 27, 2024

(65) Prior Publication Data

US 2025/0269291 A1 Aug. 28, 2025

(51) Int. Cl.
*A63H 3/28* (2006.01)
*A63H 33/26* (2006.01)

(52) U.S. Cl.
CPC ..... *A63H 3/28* (2013.01); *A63H 33/26* (2013.01); *A63H 2200/00* (2013.01)

(58) Field of Classification Search
CPC ..... A63H 3/28; A63H 2200/00; A63H 33/26
USPC ..... 446/129, 130, 132, 139, 175, 268, 297
See application file for complete search history.

(56) References Cited

U.S. PATENT DOCUMENTS 3,266,187 A * 8/1966 Felsher ..... A63H 33/26 446/132
4,237,647 A * 12/1980 Shaw ..... A63H 3/28 446/303
4,267,551 A * 5/1981 Dankman ..... G10K 15/02 446/295
5,290,198 A * 3/1994 Nakayama ..... A63H 3/24 446/297
5,295,889 A * 3/1994 Ejima ..... A63H 3/16 446/297
5,376,038 A * 12/1994 Arad ..... A63H 3/28 446/302
6,386,937 B1 * 5/2002 Cappello ..... A63H 33/26 446/139
6,592,422 B1 * 7/2003 Rehkemper ..... A63H 3/36 446/139
6,685,530 B1 * 2/2004 Rehkemper ..... A63H 3/28 446/139
6,695,672 B1 * 2/2004 Rehkemper ..... A63H 11/18 446/298
7,405,372 B2 * 7/2008 Chu ..... H03K 17/9645 446/175
7,537,506 B2 * 5/2009 de la Torre ..... A63H 13/06 446/353
7,588,478 B2 * 9/2009 Lashinsky ..... A63H 3/46 446/485
8,393,906 B2 * 3/2013 Norman ..... A63H 3/36 439/38
9,550,131 B2 * 1/2017 Loetz ..... A63H 3/006
(Continued)

*Primary Examiner* — Alexander R Niconovich
(74) *Attorney, Agent, or Firm* — The Iwashko Law Firm, PLLC; Lev Ivan Gabriel Iwashko

(57) ABSTRACT

A talking wild west action figure, including a main body, including a torso, a head attached to the torso, a plurality of arms attached the torso, such that each of the plurality of arms is movably connected to a hand at end portions thereof, and a plurality of legs attached to the torso, at least one magnet disposed within at least one of the hands, a firearm to magnetically attach to the at least one of the hands, a central Processing Unit (CPU) including a storage unit to store therewithin at least one playable audio file, such that the CPU is electronically connected to the at least one magnet disposed within at least one of the hands, and a speaker to emit a sound corresponding to the at least one playable audio file in response to the firearm magnetically attaching to the at least one of the hands.

1 Claim, 1 Drawing Sheet

(56) References Cited

U.S. PATENT DOCUMENTS

| | | | | |
|---|---|---|---|---|
| 10,661,190 | B2 * | 5/2020 | Ghaly | A63H 33/26 |
| 12,403,408 | B2 * | 9/2025 | Kosoy | A63H 3/36 |
| 2003/0162475 | A1 * | 8/2003 | Pratte | A63H 3/28<br>446/175 |
| 2007/0087655 | A1 * | 4/2007 | Rifkin | A63H 3/52<br>446/268 |
| 2007/0149091 | A1 * | 6/2007 | Viohl | A63H 3/28<br>446/484 |
| 2014/0038489 | A1 * | 2/2014 | Sharma | A63H 30/04<br>446/175 |

* cited by examiner

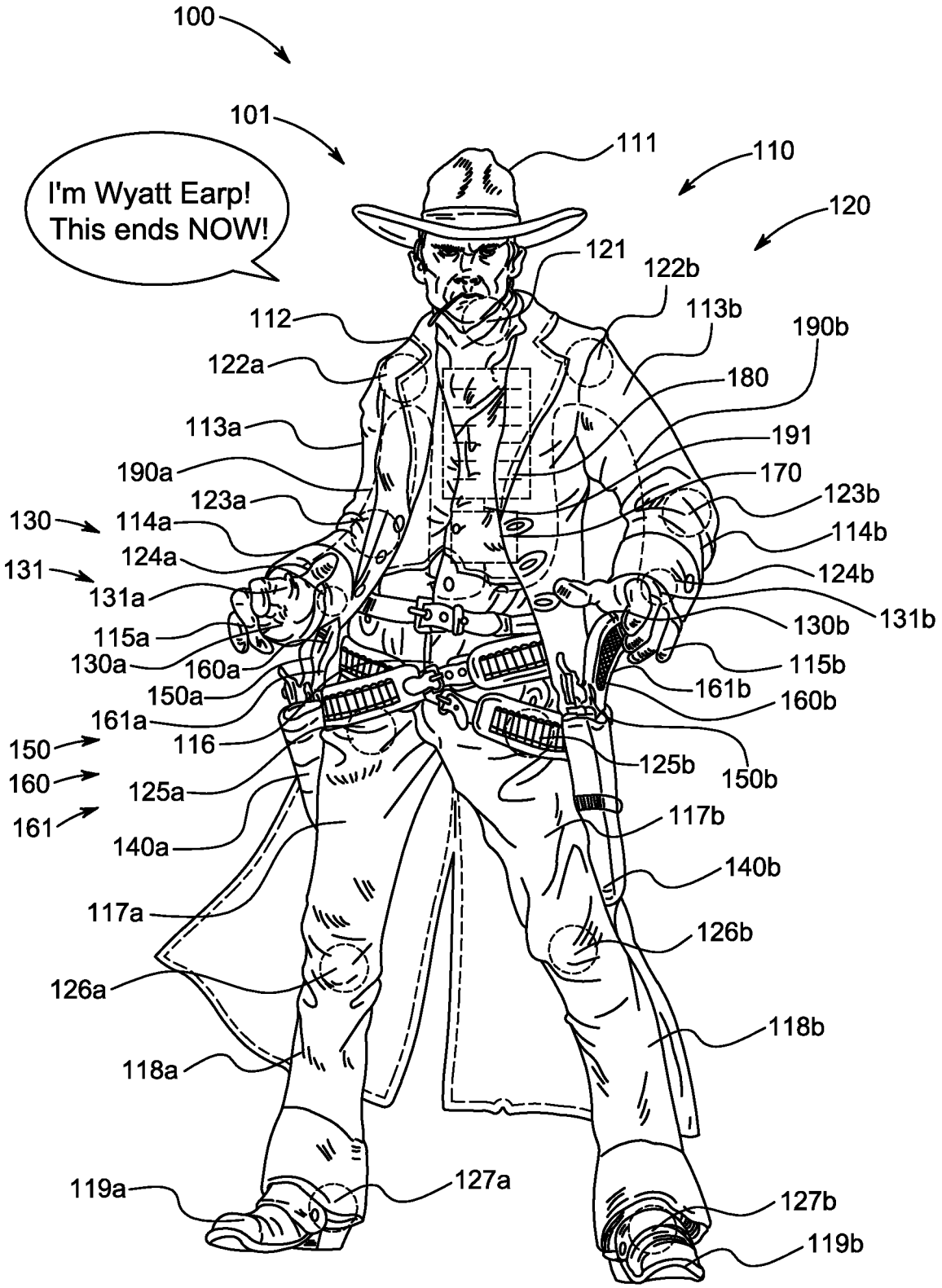
100
101
I'm Wyatt Earp!
This ends NOW!
111
110
120
121
122b
112
113b
190b
122a
180
113a
191
190a
170
123a
123b
130
114a
114b
124a
124b
131
131a
130b
131b
115a
115b
130a
160a
161b
150a
160b
161a
116
150
125b
150b
160
125a
161
117b
140a
140b
117a
126b
126a
118b
118a
119a
127a
127b
119b

TALKING WILD WEST ACTION FIGURE

BACKGROUND

1. Field

The present general inventive concept relates generally to an action figure, and particularly, to a talking wild west action figure.

2. Description of the Related Art

Although there are a wide variety of action figures available for children to play, learn, and create with, there is a scarcity of high-quality, historically accurate educational toys that honor the pillars of western lore.

Therefore, there is a need for a collection of figurines that seamlessly blends history, interactive features, and educational insights to provide an unparalleled action figure playtime experience.

SUMMARY

The present general inventive concept provides a talking wild west action figure.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a talking wild west action figure, including a main body, including a torso, a head attached to a top portion of the torso, a plurality of arms attached to side portions of the torso, such that each of the plurality of arms is movably connected to a hand at end portions thereof, and a plurality of legs attached to bottom portions of the torso, at least one magnet disposed within at least one of the hands, a firearm to magnetically attach to the at least one of the hands, a central Processing Unit (CPU) including a storage unit to store therewithin at least one playable audio file, such that the CPU is electronically connected to the at least one magnet disposed within at least one of the hands, and a speaker to emit a sound corresponding to the at least one playable audio file in response to the firearm magnetically attaching to the at least one of the hands.

The magnetic attachment of the firearm to the at least one of the hands may cause a circuit to be connected between the firearm and the CPU, thereby causing the sound to be emitted via the speaker

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates a talking wild west action figure, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Talking Wild West Action FIG. 100
Main Body 101
Body Parts 110
Head 111
Torso 112
Right Upper Arm 113*a*
Left Upper Arm 113*b*
Right Forearm 114*a*
Left Forearm 114*b*
Right Hand 115*a*
Left Hand 115*b*
Pelvis 116
Right Upper Leg 117*a*
Left Upper Leg 117*b*
Right Lower Leg 118*a*
Left Lower Leg 118*b*

Right Foot 119*a*
Left Foot 119*b*
Joints 120
Neck Joint 121
Right Shoulder Joint 122*a*
Left Shoulder Joint 122*b*
Right Elbow Joint 123*a*
Left Elbow Joint 123*b*
Right Wrist Joint 124*a*
Left Wrist Joint 124*b*
Right Femur Joint 125*a*
Left Femur Joint 125*b*
Right Knee Joint 126*a*
Left Knee Joint 126*b*
Right Ankle Joint 127*a*
Left Ankle Joint 127*b*
Hand Magnets 130
Right Hand Magnet 130*a*
Left Hand Magnet 130*b*
Hand Circuitry 131
Right Hand Circuitry 131*a*
Left Hand Circuitry 131*b*
Right Holster 140*a*
Left Holster 140*b*
Firearms 150
Right Firearm 150*a*
Left Firearm 150*b*
Firearm Magnets 160
Right Firearm Magnet 160*a*
Left Firearm Magnet 160*b*
Firearm Circuitry 161
Right Firearm Circuitry 161*a*
Left Firearm Circuitry 161*b*
Central Processing Unit (CPU) 170
Speaker 180
Arm Connector Cables 190
Right Arm Connector Cable 190*a*
Left Arm Connector Cable 190*b*
CPU to Speaker Connector Cable 191

FIG. 1 illustrates a talking wild west action FIG. 100, according to an exemplary embodiment of the present general inventive concept.

The talking wild west action FIG. 100, and all components therein and/or connected thereto, may be constructed from at least one of metal, plastic, wood, silicone, cloth, and rubber, etc., but is not limited thereto, and can be constructed from any material known to one of ordinary skill in the art.

Referring to FIG. 1, the talking wild west action FIG. 100 may include a main body 101, a plurality of body parts 110, a plurality of joints 120, a plurality of hand magnets 130, hand circuitry 131, a right holster 140*a*, a left holster 140*b*, a plurality of firearms 150, a plurality of firearm magnets 160, firearm circuitry 161, a central processing unit (CPU) 170, a speaker 180, a plurality of arm connector cables 190, and a CPU to speaker connector cable 191, but is not limited thereto.

The main body 101 may be formed in a shape of a famous wild west figure, such as Wyatt Earp, Jessie James, etc., but is not limited thereto.

The plurality of body parts 110 may include a head 111, a torso 112, a right upper arm 113*a*, a left upper arm 113*b*, a right forearm 114*a*, a left forearm 114*b*, a right hand 115*a*, a left hand 115*b*, a pelvis 116, a right upper leg 117*a*, a left upper leg 117*b*, a right lower leg 118*a*, a left lower leg 118*b*, a right foot 119*a*, and a left foot 119*b*, but is not limited thereto.

The plurality of joints 120 may be included to movably connect the various portion of the plurality of body parts 110, and may take the form of ball joints or any other type of joint known to one of ordinary skill in the art, and may include a neck joint 121, a right shoulder joint 122*a*, a left shoulder joint 122*b*, a right elbow joint 123*a*, a left elbow joint 123*b*, a right wrist joint 124*a*, a left wrist joint 124*b*, a right femur joint 125*a*, a left femur joint 125*b*, a right knee joint 126*a*, a left knee joint 126*b*, a right ankle joint 127*a*, and a left ankle joint 127*b*, but is not limited thereto.

The neck joint 121 may connect the head 111 to the torso 112, to allow the head 111 to independently move in various directions with respect to the torso 112.

The right shoulder joint 122*a* may connect the torso 112 to the right upper arm 113*a*, to allow the right upper arm 113*a* to independently move in various directions with respect to the torso 112.

The left shoulder joint 122*b* may connect the torso 112 to the left upper arm 113*b*, to allow the left upper arm 113*b* to independently move in various directions with respect to the torso 112.

The right elbow joint 123*a* may connect the right upper arm 113*a* to the right forearm 114*a*, to allow the right forearm 114*a* to independently move in various directions with respect to the right upper arm 113*a*.

The left elbow joint 123*b* may connect the left upper arm 113*b* to the left forearm 114*b*, to allow the left forearm 114*b* to independently move in various directions with respect to the left upper arm 113*b*.

The right wrist joint 124*a* may connect the right forearm 114*a* to the right hand 115*a*, to allow the right hand 115*a* to independently move in various directions with respect to the right forearm 114*a*.

The left wrist joint 124*b* may connect the left forearm 114*b* to the left hand 115*b*, to allow the left hand 115*b* to independently move in various directions with respect to the left forearm 114*b*.

The pelvis 116 may be connected to a lower portion of the torso 112, to allow the torso 112 to independently move in various directions with respect to the pelvis 116.

The right femur joint 125*a* may connect the pelvis 116 to the right upper leg 117*a*, to allow the right upper leg 117*a* to independently move in various directions with respect to the pelvis 116.

The left femur joint 125*b* may connect the pelvis 116 to the left upper leg 117 left, to allow the left upper leg 117*b* to independently move in various directions with respect to the pelvis 116.

The right knee joint 126*a* may connect the right upper leg 117*a* to the right lower leg 118*a*, to allow the right lower leg 118*a* to independently move in various directions with respect to the right upper leg 117*a*.

The left knee joint 126*b* may connect the left upper leg 117*b* to the left lower leg 118*b*, to allow the left lower leg 118*b* to independently move in various directions with respect to the left upper leg 117*b*.

The right ankle joint 127*a* may connect the right lower leg 118*a* to the right foot 119*a*, to allow the right foot 119*a* to independently move in various directions with respect to the right lower leg 118*a*.

The left ankle joint 127*b* may connect the left lower leg 118*b* to the left foot 119*b*, to allow the left foot 119*b* to independently move in various directions with respect to the left lower leg 118*b*.

The plurality of hand magnets 130 may include a right hand magnet 130*a* disposed within the right hand 115*a*, and a left hand magnet 130*b* disposed within the left hand 115*b*.

The hand circuitry 131 may include a right hand circuitry 131*a* disposed within the right hand 115*a*, and a left hand circuitry 131*b* disposed within the left hand 115*b*.

The plurality of firearms 150 may be shaped in a form of a revolver, but is not limited thereto, and may include a right firearm 150*a* to be removably disposed within the right holster 140*a*, and a left firearm 150*b* to be removably disposed within the left holster 140*b*.

The plurality of firearm magnets 160 may include a right firearm magnet 160*a* disposed within a handle of the right firearm 150*a*, and a left firearm magnet 160*b* to be disposed within a handle of the left firearm 150*b*.

The firearm circuitry 161 may include right firearm circuitry 161*a* disposed within the right firearm 150*a*, and left firearm circuitry 161*b* disposed within the left firearm 150*b*.

The CPU 170 may include electronic circuitry to carry out instructions of a computer program by performing basic arithmetic, logical, control and input/output (I/O) operations specified by the instructions. The CPU 170 may include an arithmetic logic unit (ALU) that performs arithmetic and logic operations, processor registers that supply operands to the ALU and store the results of ALU operations, and a control unit that fetches instructions from memory and "executes" them by directing the coordinated operations of the ALU, registers and other components. The CPU 170 may also include a microprocessor and a microcontroller. The transmitter CPU 170 may be a local computer device, a remote server, or cloud computing device.

The CPU 170 may also include a storage unit, a random access memory (RAM), a read-only memory (ROM), a hard disk, a flash drive, a database connected to the Internet, cloud-based storage, Internet-based storage, or any other type of storage unit.

The CPU 170 may access the Internet via an internal communication unit to allow the CPU 170 to access a website, and/or may allow for communication with a mobile application and/or a software application. For ease of description, the mobile and/or the software application will be hereinafter referred to as an app. The app may be downloaded from the Internet to be stored on the storage unit of the CPU 170.

The CPU 170 may store various phrases that were once said by a historical figure represented by the talking wild west action FIG. 100, such as "Giddy-up", "I'm Wyatt Earp . . . this ends now!", etc., but is not limited thereto.

The speaker 180 may emit sounds, such as the phrases that were once said by a character represented by the talking wild west action FIG. 100.

The arm connector cables 190 may include a right arm connector cable 190*a* to connect the right hand circuitry 131*a* to the CPU 170, and a left arm connector cable 190*b* to connect the left hand circuitry 131*b* to the CPU 170.

The CPU to speaker connector cable 191 may connect the speaker 180 to the CPU 170, such that the speaker 180 is able to play any of the phrases stored on the CPU 170.

Accordingly, when a user places the right firearm 150*a* against the right hand 115*a*, the right firearm magnet 160*a* magnetically attaches to the right hand magnet 130*a*, which causes the right firearm circuitry 161*a* to electrically connect to the right hand circuitry 131*a*, thus establishing a link between the right firearm 150*a* and the CPU 170 via the Right Arm Connector Cable 190*a*. Once the link between the right firearm 150*a* and the CPU 170 is established via the Right Arm Connector Cable 190*a*, the CPU 170 sends a signal to the speaker 180 so that the speak 180 emits a sound, such as a phrase spoken by a historical figure represented by the talking wild west action FIG. 100, such as "Giddy-up", "I'm Wyatt Earp . . . this ends now!", etc. Also, each time the right firearm magnet 160*a* detaches from and then magnetically reattaches to the right hand magnet 130*a*, the speaker 180 may emit a different phrase.

A talking wild west action FIG. 100, including a main body 101, including a torso 112, a head 111 attached to a top portion of the torso 112, a plurality of arms attached to side portions of the torso, such that each of the plurality of arms is movably connected to a hand at end portions thereof, and a plurality of legs attached to bottom portions of the torso, at least one magnet disposed within at least one of the hands, a firearm to magnetically attach to the at least one of the hands, a central Processing Unit (CPU) including a storage unit to store therewithin at least one playable audio file, such that the CPU is electronically connected to the at least one magnet disposed within at least one of the hands, and a speaker to emit a sound corresponding to the at least one playable audio file in response to the firearm magnetically attaching to the at least one of the hands.

A main purpose of the present general inventive concept is to provide users with action figurines that pay homage to Wild West characters. Expanding on the initial design of an average action figure, the present general inventive concept introduces novel ball joints that facilitate natural movement without sacrificing structural integrity of the doll. The present general inventive concept also features magnetic connections between the figure's hand and the weapons to add a layer of interactivity, triggering a voice box that uses actual quotes attributed to characters, such as: Jesse James, Wyatt Earp, and Billy the Kid. This avant-garde product includes a comprehensive booklet illustrated in captivating comic book form that accompanies each action figure which not only entertains but shares valuable insights into the historical context and significance of each character. This innovative, top-quality product serves to captivate the imagination of enthusiasts providing an immersive experience, for all ages, about the Wild West's history. As a result, the present general inventive concept may prove to be essential in the toys/hobbies industry.

The present general inventive concept is the only product of its kind that utilizes an advanced magnet mechanism for joint movement that allows the figures to hold their poses to enable dynamic reenactments and immersive storytelling. This unprecedented product is uniquely designed to be dressed in clothes made from fabric depicting the old west to further mimic the era, employs a highly advanced voice box that activates when the magnets click, and is made of durable materials to ensure long-term functionality sustaining heavy play.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A talking wild west action figure, comprising:

a main body, comprising:

a torso;

a head attached to a top portion of the torso;

a plurality of arms attached to side portions of the torso, such that each of the plurality of arms is movably connected to a hand at end portions thereof, and a plurality of legs attached to bottom portions of the torso;

at least one magnet disposed within at least one of the hands;

a first firearm configured to be magnetically attachable to the at least one of the hands;

a second firearm configured to be magnetically attachable to the at least another one of the hands;

a central Processing Unit (CPU) including a storage unit to store therewithin at least one playable audio file, such that the CPU is electronically connected to the at least one magnet disposed within at least one of the hands; and a speaker to emit a plurality of sounds corresponding to the at least one playable audio file in response to the first firearm and the second firearm magnetically attaching to the hands, wherein the magnetic attachment of the first firearm to the at least one of the hands causes a circuit to be connected between the first firearm and the CPU, thereby causing a first of the plurality of sounds to be emitted via the speaker, and wherein the magnetic attachment of the second firearm to the at least another one of the hands causes another circuit to be connected between the second firearm and the CPU, thereby causing another one of the plurality of sounds to be emitted via the speaker.

* * * * *